United States Patent [19]

Marshall

[11] Patent Number: 4,928,876

[45] Date of Patent: May 29, 1990

[54] BIFRUSTOCONICAL BEVERAGE CONTAINER, LID, MULTI-SECITONAL STRAW, AND FASTENING DEVICES

[75] Inventor: Allen S. Marshall, Columbia, S.C.

[73] Assignee: Brockington and Marshall, Columbia, S.C.

[21] Appl. No.: 350,226

[22] Filed: May 11, 1989

[51] Int. Cl.[5] ..... B65D 5/44

[52] U.S. Cl. ..... 229/103.1; 220/85 H; 220/90.4; 224/42.45 R; 224/901; 229/1.5 B; 229/1.5 H

[58] Field of Search ..... 229/1.5 B, 1.5 H, 103.1; 220/90.4, 69, 90.2, 85 H; 215/100 R, 1 A, 100.5; 224/42.45 R, 273, 901

[56] References Cited

U.S. PATENT DOCUMENTS

| | | | |
|---|---|---|---|
| 55,145 | 5/1866 | Moore | 220/69 |
| 2,131,878 | 10/1938 | Lawrence | 215/100.5 |
| 2,294,224 | 8/1942 | Daly | 215/1 A |
| 2,613,988 | 10/1952 | Jarbeau | 215/1 A |
| 3,107,028 | 10/1963 | Robertis | 215/100.5 |
| 3,211,379 | 10/1965 | Burton | 215/1 A |
| 3,529,742 | 9/1970 | Cumming | 229/69 |
| 4,226,356 | 10/1980 | Lenelson | 229/103.1 |
| 4,228,913 | 10/1980 | Mack et al. | 229/103.1 |
| 4,356,927 | 11/1982 | Cooper et al. | 229/103.1 |
| 4,494,668 | 1/1985 | Lottick | 229/103.1 |
| 4,690,294 | 9/1987 | Jones | 220/90.2 |
| 4,699,318 | 10/1987 | Donatello et al. | 215/100 R |
| 4,832,212 | 5/1989 | Askinazi | 229/1.5 B |

FOREIGN PATENT DOCUMENTS

| | | | |
|---|---|---|---|
| 304916 | 4/1955 | Switzerland | 229/103.1 |
| 530786 | 12/1940 | United Kingdom | 229/1.5 H |

*Primary Examiner*—Gary Elkins

*Attorney, Agent, or Firm*—F. Rhett Brockington

[57] ABSTRACT

A beverage container having a bottom that has been deformed such that it has a fingerlike projection that extends upward over halfway into the center of the container, where the container also has a multi-sectional drinking straw that fits over and is held upright by the projection and a closing lid that snaps on the rim. The beverage container is substantially bifrustoconical in shape, and it can be secured to a tray or drink holder equipped with a vertical element that inserts into the hollow deformation in the bottom.

14 Claims, 3 Drawing Sheets

BIFRUSTOCONICAL BEVERAGE CONTAINER, LID, MULTI-SECITONAL STRAW, AND FASTENING DEVICES

BACKGROUND OF THE INVENTION

1. Field of the Invention

The present invention relates to beverage containers and more particularly to a disposable non-spillable beverage container having the traditional cup-like frustoconical form and a container bottom where the bottom consists of a, second, smaller inverted capped conical frustum, emanating from the base of the container, where the frustum serves as an integral element of a special straw and as a fastening element. The invention also relates to accoutering components that enhance the utility of the beverage container; more particularly a special straw, a lid, and various fastening devices for securing the beverage container.

2. Description of the Prior Art The prior art has a number of patents that read on cup-like beverage containers where the cup has been modified to be inclusive of an integral straw. Leeds' 3,558,033 discloses a cup with a built in telescoping drinking straw secured to the inside surface of the cup. H. J. Drown discloses in his patent 2,948,453 a nonspillable liquid drinking container comprised of a cup, a lid, and a bendable straw that penetrates through an aperture in the lid. U.S. Pat. No. 4,573,631 reads on a beverage container having an integral straw, lid, cup combination. The straw and the lid are incorporated into the body of the cup itself.

SUMMARY OF THE INVENTION

The beverage container of the present invention includes a substantially frustoconically shaped external body member terminating in a rim at the upper extremity and a base at the lower extremity, where the base is contiguous with an internal body member that is substantially a second, smaller inverted, conical hollow core frustum terminating in an apical closure at the upper extremity and a joining flange at the lower extremity, where the flange integrally joins the internal body member with the base of the external body member, therein forming a bifrustoconical beverage container. The frustum of the internal body member emanates centrally, coaxially and upwardly from the base, the combination of the capped frustum and the flange of the internal body member therein forming the bottom of the container. The height of the frustum of the internal body member is, preferably, such that no more than half of the total volume of the total bifrustoconical container is located in the spatial region of the container defined by points consisting of a horizontal plane drawn through the external body member at the apices of the internal body member, the perimeter of the external body member, and a horizontal plane drawn through the rim of the external body member.

An object of this preferred height of the frustum of the internal body member is to structure the geometry of the container such that when the container is filled, the center of gravity of the container is below the apex of the internal body member.

A second object of the present invention is that the container can be secured by inserting, through the open ended hollow core frustoconical bottom of the container, a mounted vertical fastening element, for instance a mounted pintle or peg. The slanted walls of the conical frustum guide the insertion centrally, therein facilitating alignment of the container into a fixed position. Also, if the vertical fastening element is of sufficient length to contact the underside of the apex and the vertical fastening element has a radial thickness smaller than the smaller radius of the frustum, then the beverage container, resting on the vertical element, will be self righting through a maximum angle of deflection functionally dependent on the angle of the walls of the frustum from its axis. The underside of the apex will serve as the pivot point, and the top of the vertical fastening element will serve as the fulcrum.

The bifrustoconical beverage container is composed of a malleable material, preferably a resilient plastic material. The preferred method of manufacture is a molding process using an extrudable plastic material. It is anticipated that molding processes are amenable to making very complex shapes, and that variations on the basic bifrustoconical design can and will be adopted. For instance, the external body member could be a combination of an octabedral frustum and a conical frustum; and the internal body member could be Gaussian in shape.

A third object of the present invention is that the beverage container has substantially a bifrustoconical shape, and the invention is inclusive of variations on this general design.

The beverage container of the present invention includes a closing lid which fastens to the rim of the external body member. The epicenter of the lid has a closed straw passage and opening means, where the passage is of sufficient size to allow an inserted straw to snugly pass through the resulting aperture when the passage is opened. The passage is normally closed, unless a straw is about to be or has been inserted into the passage.

The beverage container of the present invention includes a novel multi-sectional straw, being comprised of an upper essentially linear tubular section, a lower essentially conical frustum section, and an intermediate expander section which integrally joins the upper tubular section to the lower conical frustum section, and in particular the smaller circular end of the lower conical frustum section. The uppermost end of the tubular section of the straw is the exit, and, therefore is open ended, being the point of fluid conveyance to the drinker; and the periphery of the lowermost end of the conical section of the straw is the entrance. The conical section of the multisectional straw is sized so that the interior wall of the conical section will fit superimposed over substantially the entire length of the frustum of the internal body member, therein forming a thin annular chamber in between the straw and the frustum of the internal body member. Furthermore, the conical section of the straw is preferably sized such that the thin annular chamber has a horizontal cross-sectional area that is nearly invariant as to the height on the superimposed frustums, and that this cross-sectional area is roughly equal to the cross-sectional area of the tubular section of the straw. The conical section of the straw is positioned such that fluid can communicate from the lower most bottom of the container, through the straw entrance and into the thin annular chamber. Positioning can be affected through the use of tabs at the entrance of the straw, flutes or small protuberances on the interior walls of the conical section of the straw or any other suitable means. The intermediate expander section of the straw serves to expand the diameter of the tubular section of the straw up to the diameter of the conical frustum section of the straw, and through this transition, the expander section closely follows the exterior contour of the apices of the internal body member. As a functioning straw, fluid is drawn in radially through the periphery of the straw entrance into the thin annular chamber, upward in the superimposed frustums, into the intermediate expander section and into the tubular section of the straw. The drinker when consuming a very viscous beverage such as a milk shake has the option of increasing the effective diameter of the conical frustum section of the straw by simply lifting the straw upwards out of the container slightly, which increases the size of the thin annular chamber, therein making it easier to suck the contents through the straw into the drinker's mouth. The conical frustum section of the straw also tends to align stringy consumables like noodles, and certain soups can be eaten using this multi-sectional straw that will not pass through an conventional straw.

An object of the present invention is that the tubular section of the multi-sectional straw has corrugated ribbing that imparts flexibility to the tubular section. The corrugation allow the tubular section of the straw to be bent, without crimping, therein enabling the straw to be adjusted to an angle more suitable for consumption without tilting the beverage container.

An object of the present invention is that the beverage container, fitted with a straw, can be filled with ice or beverage without knocking the straw out of the container. The internal body member serves to hold the straw upright whilst the the container is being prepared; conventional straws, unless affixed to the container tend to fall out.

In part, because of the unusualness of the multi-sectional straw, it is anticipated that retailers will adapt various advertising devices and trademarks to the tubular end of the straw. The multi-sectional straw bears a strong resemblance to a horn, and this also is anticipated to have potentially important commercial ramifications.

An object of the present invention is that the beverage container may be fitted with a lid and a multi-sectional drinking straw, wherein the straw is superimposed on the frustum of the internal body member and penetrates the epicenter of the lid through the straw passage, and that when the container is fitted with a lid and the multi-sectional straw, its fluid contents will be retained if the container is overturned.

The present invention includes various fastening devices for securing the bifrustoconical beverage container to a fixed surface. Beverage containers, particularly cups and cans, are traditionally immoblized in a car using holders that clasp the container. An object of the present invention is that the beverage container can be either clasped or passively restrained by interpositioning the appropriate vertical fastening element within the container, and that in contrast to a clasp method of fastening, which requires a different clasp for each size of container, the interposition method of fastening enables a single device to hold various size containers.

The present invention includes various food conveyance devices having one or more vertical fastening elements which project upward from a horizontal body surface on the device. Fastening devices are inclusive of conventional food trays, automobile floor and dashboard mounted trays, and car door drink holders as well as other vehicular food holders.

In the case of dedicated beverage holders, such as car door drink holders which are S shaped and hook into the slot which houses the window, the beverage holder device for a bifrustoconical container has a vertical fastening element emanating from the base of the holder. The requirement for clasping or encircling side arms on the holder is obviated by the vertical fastening element, and therefore would be unnecessary. The fastening element, such as pintle, is sized such that various volume bifrustoconical containers will fit onto the holder.

In the case of trays, they are traditionally designed to hold either a set number of beverage containers or are substantially flat and do not restrict movement of a beverage container if the container is placed in an accelerated state, such as when a car is turning or stopping. The present invention includes trays which are substantially flat, where the horizontal body surface of the tray is fitted with one or more vertical fastening elements that emanate from the body surface of the tray, and where the vertical fastening element may be permanent or removable from the body surface. The elements are sized such that various volume bifrustoconical containers will fit onto the tray. A preferable design of a tray suitable as a take-out tray for a past food restaurant is a substantially flat rectangular tray where the body surface of the tray has four or more cylindrical receses which can be fitted with a vertical fastening element. The tray can be modified to match the number of beverage containers on an order by order basis.

An object of the present invention is that the body surface of the food conveyance device is fitted with a vertical fastening element for a bifrustoconical beverage container, and that the vertical fastening element may be removable.

Another object of the invention is that one bifrustoconical beverage container can be nested within another similar container, and that the containers are stackable and nestable.

A final object of the invention is that the bifrustoconical beverage container may have a handle.

DESCRIPTION OF THE PREFERRED EMBODIMENT

Figure 1:
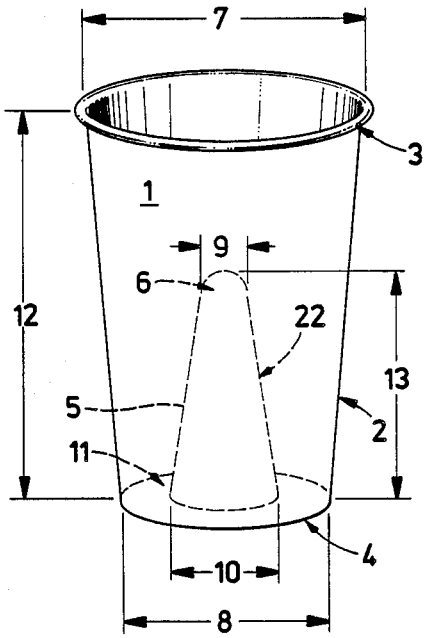
FIG. 1 is a perspective view of a bifrustoconical beverage container which has an inverted bottom protruding upward into the interior of the container.

FIG. 1 illustrates perspectively a bifrustoconical beverage container 1 having an external body member 2 with a rim 3 and a base 4. The container 1 has an internal body member 5, shown in relief in FIG. 1 as dashed lines, which is also substantially frustoconical in shape. Internal body member 5 emanates centrally and coaxially from the epicenter of the base 4 upwardly into the container, therein forming an inverted bottom. The uppermost extremity of the internal body member frustum is closed, terminating in a hemispherically shaped apices 6, and the lowermost extremity is terminated with a flange 11, which integrally joins the internal body member 5 with the base 4 of the external body member 2, therein forming a bifrustoconical beverage container 1. In the preferred embodiment the internal body member frustum 22 is substantially smaller than the external body member frustum 2, and displaces only a relatively small portion of the apparent volume of the container. TABLE 1 lists the dimensions and volumes of several bifrustoconical containers. The diameter of the larger frustum at the rim 7, the diameter at the base 8, and the height 12 define the apparent volume of the container per the external body member frustum 2. The diameter of the smaller frustum at the apices 9, the diameter at the flange 10, and the height 13 define the displacement volume of the internal body member frustum 22. Their difference (Volume 2–Volume 22) equals the actual volume of the container.

TABLE 1

| | Frustum-larger | | | Frustum-smaller | | | Volume (oz) Actual Apex | | |
|---|---|---|---|---|---|---|---|---|---|
| | 12 | 7 | 8(in) | 13 | 9 | 10(in) | | | |
| NO. | hgt. | dia. | dia. | hgt. | dia. | dia. | Total | Above | Below |
| 1 | 4.25 | 3.50 | 2.64 | 2.65 | 1.20 | 1.50 | 16.0 | 7.9 | 8.1 |
| 2 | 4.25 | 3.50 | 2.64 | 2.50 | 0.62 | 1.00 | 17.4 | 8.5 | 8.8 |
| 3 | 5.00 | 3.00 | 2.64 | 2.95 | 1.20 | 1.50 | 15.6 | 7.8 | 7.8 |
| 4 | 5.00 | 3.00 | 2.64 | 2.95 | 0.62 | 1.50 | 17.1 | 7.8 | 9.3 |
| 5 | 7.50 | 8.00 | 5.00 | 6.00 | 1.60 | 2.00 | 132.2 | 38.9 | 93.3 |
| 6 | 7.50 | 8.00 | 5.00 | 8.50 | 1.60 | 2.00 | 128.6 | 0.0 | 128.6 |
| 7 | 3.75 | 2.80 | 1.80 | 2.40 | 0.60 | 1.00 | 8.1 | 4.1 | 4.0 |
| 8 | 3.75 | 2.80 | 1.80 | 2.79 | 0.60 | 1.00 | 8.0 | 3.0 | 5.0 |
| 9 | 4.25 | 3.50 | 2.65 | 2.90 | 1.00 | 1.60 | 16.0 | 6.7 | 9.3 |
| 10 | 4.25 | 3.50 | 2.65 | 4.25 | 0.94 | 1.20 | 16.0 | 0.0 | 16.0 |
| 11 | 4.25 | 3.50 | 2.64 | 0.00 | 0.00 | 0.00 | 18.1 | — | — |
| 12 | 0.00 | 0.00 | 0.00 | 2.65 | 1.20 | 1.50 | −2.1 | — | — |
| 13 | 3.75 | 2.80 | 1.80 | 0.00 | 0.00 | 0.00 | 8.8 | — | — |
| 14 | 0.00 | 0.00 | 0.00 | 2.79 | 0.60 | 1.00 | −0.8 | — | — |

In Table 1, No 1–10 list the dimensions and calculated actual volumes of several bifrustoconical containers. The height of the smaller frustum has been sized such that even when the container is full, more than half of the fluid volume would be located below the level of the apicies 6 of the internal body member. This choice of dimensions results in a container having a center of gravity, wherein a portion of the the bottom is actually located higher than the center of gravity of the container 1. Therefore, a container fastened at the apex would tend to be self righting with the larger fluid ballast located lower than the point of attachment. In Table 1, No 11–12 are volumetric breakdowns of container No. 1, and No 13–14 are breakdowns of container No 8. No 5 and 6 are gallon containers.

Figure 2:
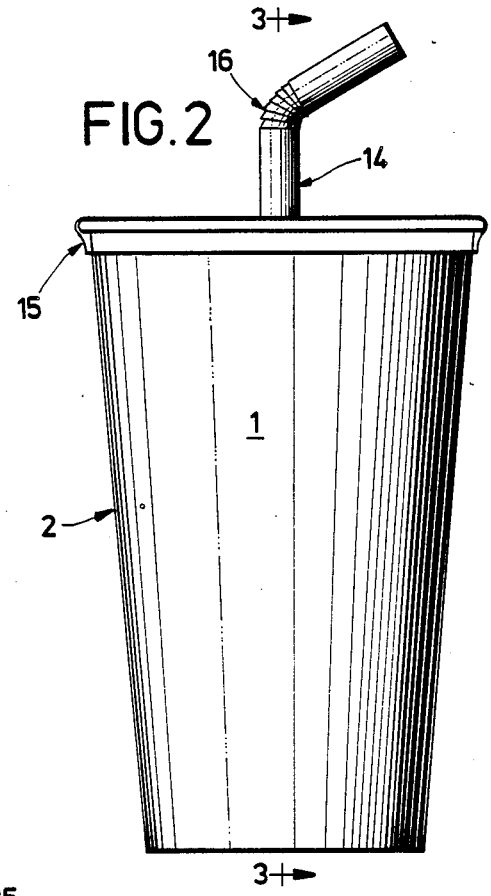
FIG. 2 is a perspective view of the container in FIG. 1 wherein the container has been fitted with a closing lid and a multi-sectional straw.

FIG. 2 is a perspective view of a bifrustoconical container 1 fitted with a multi-sectional straw 14 and a sealing lid 15. The straw 14 has corrugated ribbing 16 that enables it to be bent without crimping.

Figure 3:
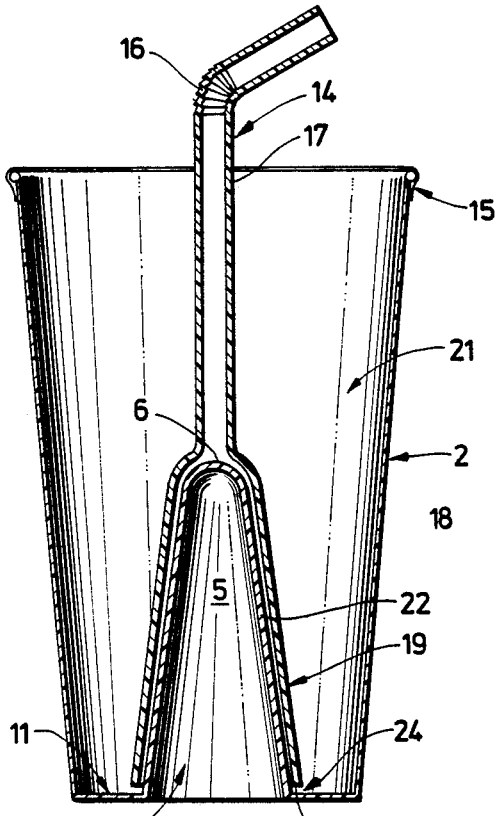
FIG. 3 is a vertical sectional view taken substantially upon the plane indicated by section line 3—3 of FIG. 2.

FIG. 3 is a vertical sectional view of FIG. 2 taken along sectional line 3-3. Multi-sectional straw 14 is superimposed on the frustum 22 of the internal body member 5. The straw is comprised of three sections, the upper essentially tubular section 17, the frustoconical section 19, and the expander section 18, which integrally joins section 17 and section 19. The straw's frustoconical section 19 is just slightly larger than the internal body member frustum 22, and 19 extends to very near the flange 11, which is the lowermost bottom of the container. There is a thin annular chamber 20 formed by the superimposed frustums, and, under the force of gentle suction, the fluid beverage is pulled into the straw through the gap 24 between the perimeter of lower extremity of the frustoconical section 19 of the straw and the flange 11 of the internal body member. The fluid is transported upward through the thin annular chamber 20, into the expander section 18 of the straw and through the tubular section 17, where it exits the top. The core 23 of the internal body member frustum 22 is hollow, and open from the underside of the container 1. The core 23 serves as a fastening element for the container when an interpositioning vertical fastening element such as a peg or a pintle is inserted into the core.

Figure 4:
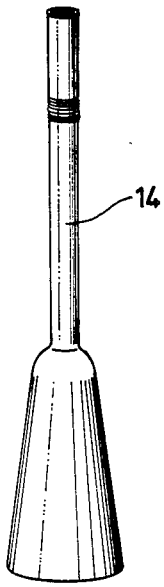
FIG. 4 is a perspective view of the multi-sectional straw sectionally shown in FIG. 3.

FIG. 4 is a perspective view of the straw 14 sectionally shown in FIG. 3. The illustrated straw is not been bent, so that it may be pushed through the straw passage in the lid 15.

Figure 5:
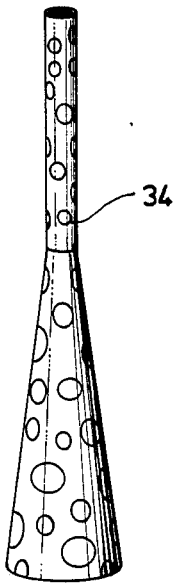
FIG. 5 is a perspective view of a decorative version of a multi-sectional straw.

FIG. 5 is a perspective view of a decorative version 34 of the multi-sectional straw 14 that has been constructed to look like a horn. The unique design of a multi-sectional straw has obvious novelty appeal, and, as such, lends itself to be fashioned into various toys and promotional paraphernalia to commercially utilize this novelty.

Figure 6:
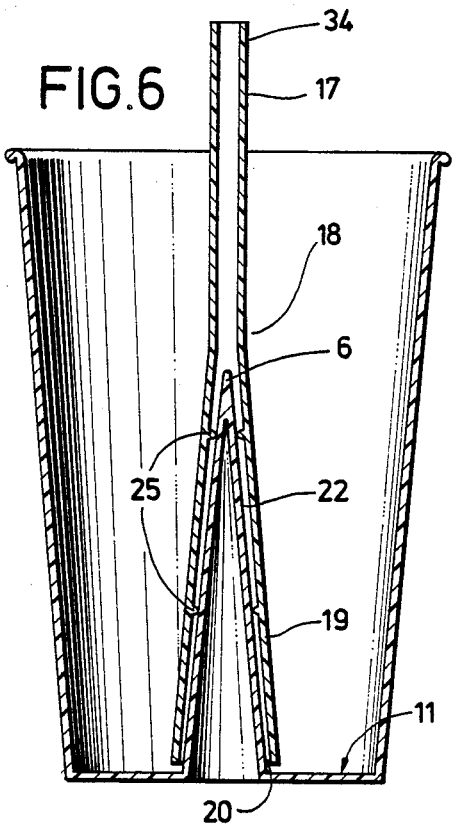
FIG. 6 is a vertical sectional view of a bifrustoconical beverage container fitted with the decorative straw shown in FIG. 5, wherein the shape of the frustoconical bottom of the container has been altered from that shown in FIG. 3 so as to match the decorative straw.

FIG. 6 is a vertical sectional view of a bifrustoconical beverage container 1 fitted with a decorative multi-sectional straw 34 having a transitionally less pronounced expander section 18 joining the tubular section 17 to the frustoconical section 19. The inside wall of the frustoconical section of the straw has inwardly projecting point like protuberances 25 which hold the straw 34 away from from the internal body member frustum 22, therein establishing the width of the annular chamber 20. In order to accommodate the essentially conically shaped straw, the internal body member has a more nearly pure conical shape, and, in particular, the apicies 6 is substantially less rounded, and much more tapered.

Figure 8:
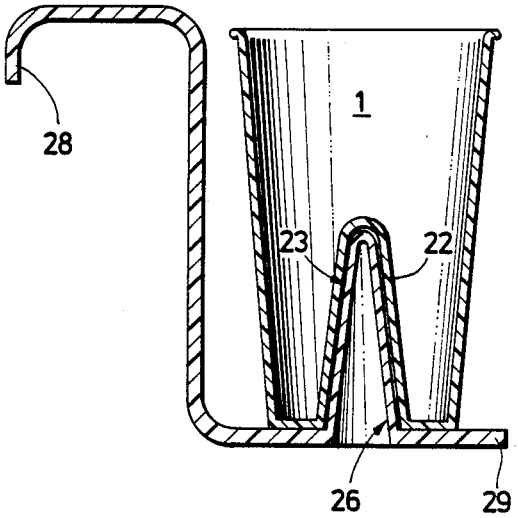
FIG. 8 is a vertical sectional view taken substantially upon the plane indicated by section line 8—8 of FIG. 7. A vertical sectional view of a bifrustoconical beverage container has been included in FIG. 8 for clarification of how the car door drink holder works.
Figure 7:
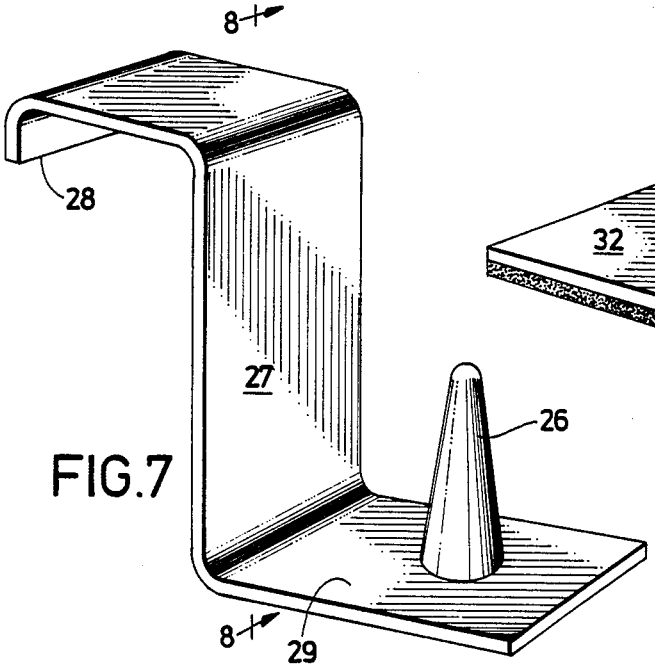
FIG. 7 is a perspective view of a car door drink holder designed specifically for securing bifrustoconical beverage containers.

The bifrustoconical beverage container can be temporarily secured to a position on a food conveyance holder (for instance a tray or a drink holder) with a variety of fastening devices, all of which have a vertical fastening element in common. The vertical fastening element inserts through the bottom of the container into the open ended hollow core 23 of the internal body member. FIG. 7 is a perspective view of a car door drink holder 27 with a singular vertical fastening element 26. The top 28 of the "S" shaped holder 27 hooks into the window slot. The vertical fastening element 26 projects upward from a flat horizontal plate 29 comprising a lower portion of the holder 27. FIG. 8 sectionally shows a vertical fastening element 26 that has been molded into the body of the plate 29 of the car door drink holder 27. The element 26 is sized so that it can be interpositioned essentially completely within the hollow core 23 of the internal body member frustum 22.

Figure 9:
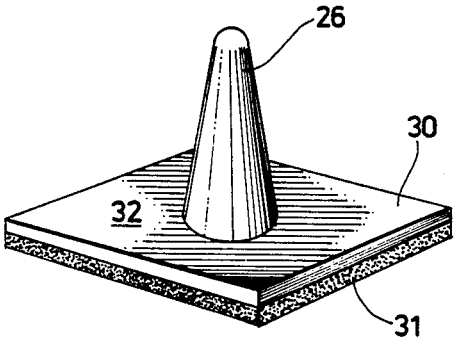
FIG. 9 is a perspective view of a car dash board drink holder that can be adhesively mounted to flat surfaces for purposes of securing a bifrustoconical beverage container.

Another holder device 32 used to secure a bifrustoconical beverage container 1 in a vertical is shown in FIG. 9. The vertical fastening element is mounted on a structural rectangular base 30, the underside of which is adhesively coated for bonding the device 32 to a fixed planar surface, such as the dash board of a car or a window sill.

Figures 10, 11:
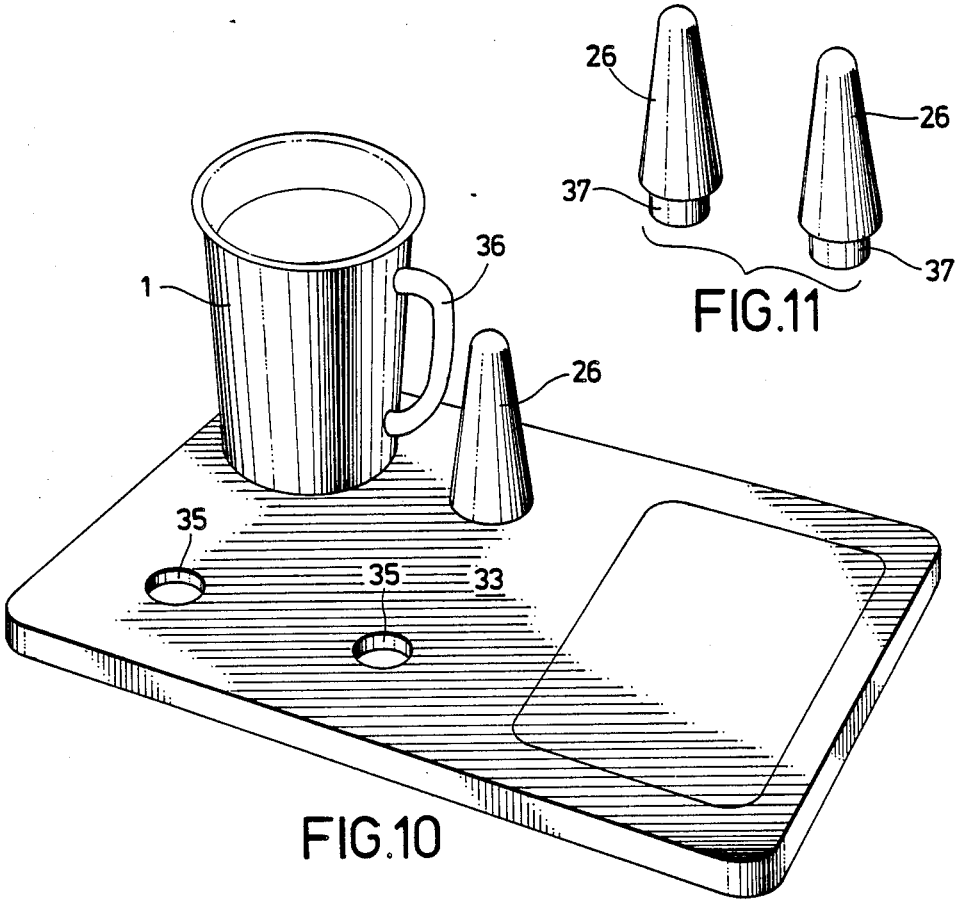
FIG. 10 is a perspective view of a food conveyance tray which is fitted with two vertical fastening elements, one of which is being utilized. The tray has cylindrical recesses which can be fitted with additional vertical fastening elements for securing containers on an as needed basis.
FIG. 11 is a perspective view of a couple of vertical fastening elements which can be fitted into the cylindrical recesses in the tray shown in FIG. 10.

Another adaptation of food conveyance holders is shown in FIG. 10. The tray 33 is fitted with two vertical fastening elements 26, one of which is obscured from view by the resting secured beverage container 1. Bifrustoconical beverage container 1 has a handle 36 to improve handleability. The body of the tray has two cylindrical depressions 35 into which can be fitted additional vertical fastening elements 26, therein enabling very easy modification of the tray 33 to accommodate additional beverages. The tray has the advantage that with detachable vertical fastening elements, substantially all of its planar surface can be utilized to hold non-spillable foods or it can, alternatively, be adapted to hold multiple containers 1. The detachable vertical fastening elements 26 are shown in FIG. 11. The length of the element has been extended to include a detachable means which interlocks with the cylindrical depressions 35 in the tray 33.

I claim:

1. A beverage container having substantially a frustoconical hollow core external body member, wherein the core of the external body member shall be referred to as the inside, where said external body member terminates in a rim at an upper extremity and a base at the other extremity, wherein said base is contiguous with an internal body member, said internal body member forming a bottom of the beverage container, wherein said internal body member is also a functional component and a fastening means of a unique multi-sectional straw, and a component of a fastening means for temporarily attaching the beverage container to a surface, the improvement in combination therewith comprising:

a. an internal body member that is substantially a second, smaller inverted, conical hollow core frustum terminating in an apical closure at the upper extremity and open ended and fitted with a joining flange at the other extremity, where the flange integrally joins the internal body member to the base of the external body member forming, substantially, a bifrustoconical container, where the frustum of the internal body member emanates centrally, coaxially and upwardly from the inside of the base, wherein the inverted hollow core frustum results inn a beverage container having a bottom with two functional fastening means, one fastening means for securing the container to a fastening device having a vertical fastening element, wherein fastening is affected by interpositioning the vertical fastening element within the core of the internal body member, and a second fastening means for holding upright a unique multi-sectional straw;

b. a multi-sectional straw, which rests and is superimposed on the frustum of the internal body member, wherein said multi-sectional straw is comprised of an upper substantially linear tubular section, a lower hollow core frustoconical section, and an intermediate expander section which integrally joins the tubular section to the frustoconical section, where the multi-sectional straw has an overall length that is sufficient to extend from the base of the beverage container to above the rim, where the frustoconical section of the straw is sized such that when superimposed on the frustum of the internal body member, the superimposed straw and the internal body member form a thin annular chamber between an inside surface of the core of the straw and an outside surface of the frustum of the internal body member, wherein said annular chamber enables a fluid to be conveyed, under the force of slight suction, from the inside at the base of the container upward through and out of the tubular section of the straw;

c. a closing lid which fastens to the rim of the beverage container, where said lid has a closed straw passage and an opening means, and where the passage is of sufficient size to allow an inserted straw to pass through when the passage is open.

2. The beverage container as claimed in claim 1 where the frustum of the internal body member has a height such that no more than half of the total volume of the beverage container is located in the spatial region above the height, defined by points consisting of a horizontal plane at the height of the internal body member, the inside of the external body member, and a horizontal plane at the rim; wherein the resulting container will have a center of gravity located below the height of the frustum of the internal body member.

3. The beverage container as claimed in claim 1 where the apical closure of the internal body member is substantially hemispherical in shape and forms the uppermost portion of the internal body member.

4. The beverage container as claimed in claim 1 where the multi-sectional straw has vertical flutes or other small protuberances that hold the straw at a fixed gap from the frustum of the internal body member, therein setting a thickness for the annular chamber.

5. The beverage container as claimed in claim where the tubular section of the multi-sectional straw is fitted with corrugated ribbing therein enabling the tubular section to be bent without crimping the straw.

6. The beverage container as claimed in claim 1 where the external and the internal body members are sized such that the beverage containers are nestable.

7. The beverage container as claimed in claim 1 where the container is formed using a molding process employing a resilient plastic material.

8. The beverage container as claimed in claim 1 where the container is fitted with a handle.

9. A fastening device for securing the beverage container claimed in claim 1, where said device is used to convey food and beverage using a vehicular means, where said device is comprised of a vertical fastening element which inserts through the bottom of the claimed container into the hollow core of the frustum of the internal body member, therein interpositioning said element within the bottom of the container.

10. The fastening device as claimed in claim 9 where the device is a car door drink holder that is substantially block "S" shaped, where the upper portion of the device hooks into the car window slot, and the lower portion of the device has a horizontal planar surface from which perpendicularly emanates a vertical fastening element that is substantially shaped like the hollow core of the frustum of the internal body member, wherein said vertical fastening element will fit inside the container and the base of the container will rest on the planar surface.

11. The fastening device as claimed in claim 9 where the device is a car dashboard drink holder that is substantially a structural base having an adhesively coated under side which will adhere to the dashboard, and a top side that has a horizontal planar surface from which perpendicularly emanates a vertical fastening element that is substantially shaped like the hollow core of the frustum of the internal boby member, wherein said vertical fastening element will fit inside the container and the base of the container will rest on the planar surface.

12. The fastening device as claimed in claim 9 where the device is a ray that is substantially a planar structural surface from which perpendicularly emanates one or more vertical fastening element that is substantially shaped like the hollow core of the frustum of the internal body member, wherein said vertical fastening element will fit inside the container and the base of the container will rest on the planar surface.

13. The tray as claimed in claim 12 where the vertical fastening elements are detachable from the tray.

14. The tray as claimed in claim 13 where the vertical fastening elements are reattachable to the tray.

* * * * *